US009688520B1

(12) United States Patent
Khalil

(10) Patent No.: US 9,688,520 B1
(45) Date of Patent: Jun. 27, 2017

(54) WINCH ASSEMBLY

(71) Applicant: Ellicott Dredge Enterprises, LLC, Baltimore, MD (US)

(72) Inventor: Rabie E. Khalil, Baltimore, MD (US)

(73) Assignee: ELLICOTT DREDGES, LLC, Baltimore, MD (US)

( * ) Notice: Subject to any disclaimer, the term of this patent is extended or adjusted under 35 U.S.C. 154(b) by 0 days.

(21) Appl. No.: 15/384,049

(22) Filed: Dec. 19, 2016

(51) Int. Cl.
*B66D 1/08* (2006.01)
*B66D 1/44* (2006.01)
*B66D 5/00* (2006.01)

(52) U.S. Cl.
CPC ..... *B66D 1/44* (2013.01); *B66D 5/00* (2013.01); *B66D 2700/0158* (2013.01)

(58) Field of Classification Search
CPC ... B66D 1/08; B66D 1/12; B66D 1/40; B66D 5/18; B66D 2700/0133; B66D 2700/035
See application file for complete search history.

(56) References Cited

U.S. PATENT DOCUMENTS 3,572,482 A * 3/1971 Kalpas ..... B66D 5/00 192/12 B
3,688,878 A * 9/1972 Barmasse ..... F16D 55/40 188/170
3,895,779 A * 7/1975 Cassez ..... B66D 1/08 254/361
4,223,871 A * 9/1980 Braithwaite ..... B66D 1/741 254/291
4,275,803 A * 6/1981 Putney ..... F16D 59/00 188/134
4,312,497 A * 1/1982 Whaley ..... B66D 1/22 254/344
4,434,616 A * 3/1984 Christopher ..... F16H 61/433 60/445
8,636,265 B1 * 1/2014 Soot ..... A63J 1/028 254/334
2003/0205703 A1 * 11/2003 McCormick ..... B66B 1/32 254/267
2008/0116432 A1 * 5/2008 Folk ..... E21B 19/008 254/362
2010/0127229 A1 * 5/2010 Kverneland ..... B66D 1/12 254/356

OTHER PUBLICATIONS

Zollern, "Drive Technology, Free fall Winches", www.zollern.com, pp. 1-12 (Mar. 2016).
Zollern, "Rope Winches and Geerboxes", www.zollern.com, pp. 1-20 (Mar. 2016).

(Continued)

*Primary Examiner* — Emmanuel M Marcelo
(74) *Attorney, Agent, or Firm* — Finnegan, Henderson, Farabow, Garrett & Dunner, L.L.P.

(57) ABSTRACT

A winch assembly is disclosed. The winch assembly may have a support with parallel plates spaced apart from each other. The winch assembly may also have a drum with a hollow spool between the parallel plates, and a shaft passing axially through and being connected to the hollow spool. The winch assembly may further have a motor directly connected to an end of the shaft, and a fail-safe-brake directly connected to an end of the shaft.

20 Claims, 4 Drawing Sheets

(56) References Cited

OTHER PUBLICATIONS

Pull Master, "Experience the Power of Pullmaster Planetary Winches" www.team-twg.com, pp. 1-16 ( © 2009).
Pull Master, "Instruction and Parts Model Model M12 Freespool Planetary Hydraulic Winch" www.team-twg.com, PMC 256, 1-32 (Effective Oct. 1, 2011).
LANTEC, "Strength You Can Depend On", Pull Master. www.team-twg.com, pp. 1-53 (Nov. 14, 2011).

* cited by examiner

WINCH ASSEMBLY

TECHNICAL FIELD

The present disclosure is directed to a winch assembly, and more particularly, to a winch assembly having a radial-piston motor with direct drive.

BACKGROUND

A winch is an assembly of rotary components that cooperate to haul in or pay out a tether (e.g., a steel cable, a rope, a chain, etc.), which may be under high tension. Winches can be used in any industry and for any purpose. For example, a winch can be used on a dredge to lift and/or swing a suction ladder, on a vessel to raise an anchor, on logging equipment to pull logs to a landing, on a crane to pick up a load, and in a building to raise an elevator. Winches can be electrically powered, hydraulically powered, pneumatically powered, and/or mechanically powered (e.g., by an engine).

A conventional winch includes a drum, about which the tether is coiled. The drum is rotationally mounted within a support by way of dedicated bearings. A power source (e.g., a high-speed hydraulic motor) is connected to a shaft of the drum via a reducing gear box. The reducing gear box includes a housing, and a planetary gear arrangement disposed in the housing. The planetary gear arrangement reduces an input speed supplied by the hydraulic motor, while simultaneously increasing an output torque driving the shaft of the drum. A parking or fail-safe-brake is generally connected to an end of the shaft opposite the motor and gear box, and functions to prevent rotation of the drum in the event of a failure (e.g., an electric power failure). A dynamic brake is generally disposed inside the drum and connected to the shaft via a 3-way clutch. Although conventional winches may be adequate for some applications, they can also have numerous heavy components, require a large operating space, and be complex and costly.

The winch assembly of the present disclosure addresses one or more of the needs set forth above and/or other problems of the prior art.

SUMMARY

In accordance with one aspect, the present disclosure is directed to a winch assembly. The winch assembly may include a support having parallel plates spaced apart from each other. The winch assembly may also include a drum having a hollow spool between the parallel plates, and a shaft passing axially through and being connected to the hollow spool. The winch assembly may further include a motor directly connected to an end of the shaft, and a fail-safe-brake directly connected to an end of the shaft.

According to another aspect, the present disclosure is directed to another winch assembly. This winch assembly may include a support having parallel plates spaced apart from each other. The winch assembly may also include a drum having a hollow spool between the parallel plates, and a shaft passing axially through and being connected to the hollow spool. The winch assembly may further include a radial-piston motor directly connected to a first end of the shaft, and an energy recuperation mechanism connected to the radial-piston motor. The first end of the shaft may extend through the radial-piston motor to engage the energy recuperation mechanism.

According to yet another aspect, the present disclosure is directed to a winch system. The winch system may include a support having parallel plates spaced apart from each other, and a drum having a hollow spool between the parallel plates and a shaft passing axially through and being connected to the hollow spool. The winch system may also include a motor directly connected to a first end of the shaft, and an energy recuperation mechanism connected to the motor. The shaft may extend through the motor to engage the energy recuperation mechanism. The winch system may further include a pump configured to supply the motor with pressurized fluid, an accumulator configured to receive pressurized fluid from one of the motor and the energy recuperation mechanism, and at least one control valve fluidly connected to the motor, the energy recuperation mechanism, and the pump.

DETAILED DESCRIPTION

Figure 1:
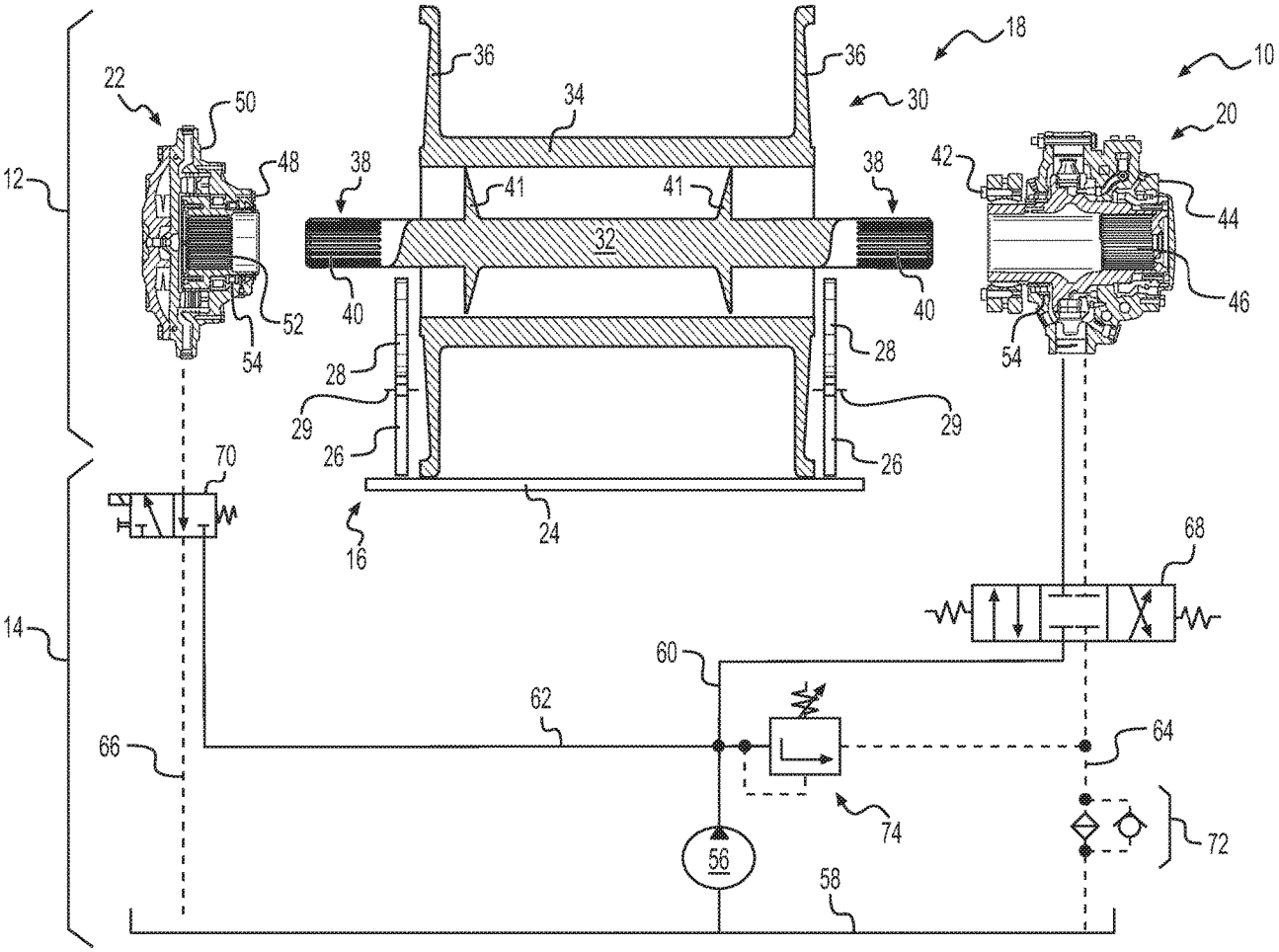
FIG. 1 is a diagrammatic illustration of an exemplary winch system.

FIG. 1 illustrates an exemplary winch system ("system") 10 adapted for use with a dredge (not shown), for example to raise and lower a suction ladder, to swing the suction ladder, to raise and lower an anchor, or to raise and lower a spud. It should be noted, however, that system 10 could be used in another application, if desired. System 10 may include a winch assembly ("assembly") 12, and a hydraulic circuit 14 configured to power assembly 12.

Assembly 12 may include, among other things, a support 16, a drum 18, a power source 20, and a fail-safe-brake (FSB) 22. Support 16 may be configured for connection to another machine, for example to a deck of the dredge. For example, support 16 may include a horizontal bottom plate 24, which can be welded and/or bolted to the deck. Support 16 may also include vertical plates 26 that extend away from bottom plate 24 at spaced-apart locations. Vertical plates 26 may be generally parallel to each other, generally perpendicular to bottom plate 24, and connected to bottom plate 24 by way of welding and/or threaded fastening. An upper edge 28 of each vertical plate 26 may be recessed (e.g., cut away) and have a curved profile that provides clearance for rotating portions of drum 18, power source 20, and/or FSB 22. A plurality of connection features (e.g., threaded or unthreaded holes) 29 may be formed within each vertical plate 26 adjacent a perimeter of upper edge 28 for connection with stationary portions of power source 20 and/or FSB 22. Drum 18 may be received axially between vertical plates 26 and supported vertically and axially via power source 20 and/or FSB 22, such that a clearance exists between all portions of support 16 and drum 18. It is contemplated that, in some embodiments, bottom plate 24 could be omitted and vertical plates 26 connected directly to the deck of the dredge (or another machine), if desired.

Drum 18 may include a spool 30, and a shaft 32 passing through a center of spool 30. Spool 30 may have a generally cylindrical and hollow center portion 34, and radially extending flanges 36 located at opposing axial ends. Center portion 34 may be fabricated, for example, from steel pipe (e.g., via a cutting process); and flanges 36 may thereafter be welded to axial ends of the steel pipe. An outer diameter of center portion 34 and outer diameters of flanges 36 may vary and be dependent on a diameter and length of the tether to be coiled around drum 18. A wall thickness and corresponding inner diameter of center portion 34 may be dependent on a maximum tension anticipated within the tether. Although not shown, a tether anchoring feature (e.g., a slot, a hole, an anchor, etc.) may be connected to center portion 34 and/or flanges 36 and used to anchor a base end of the tether to drum 18.

Shaft 32 may pass through the hollow center of drum 18 and include opposing ends 38 that extend axially past flanges 36 (and past vertical plates 26 during assembly). One or more external connection features (e.g., splines) 40 may be formed at ends 38 to facilitate connection of shaft 32 with power source 20 and/or FSB 22. Shaft 32 may be rotationally fixed to spool 30, such that rotational torque exerted on ends 38 by power source 20 and/or FSB 22 may be passed to spool 30 and on to the tether coiled around center portion 34. In the disclosed embodiment, conical discs 41 extend between an outer annular surface of shaft 32 and an inner annular surface of spool 30 (i.e., of center portion 34). Conical discs 41 may be integrally formed with shaft 32 and welded to spool 30, or welded to both of shaft 32 and spool 30. It is contemplated that conical discs 41 could be replaced with components having different shapes (e.g., rectangular discs, spokes, etc.), if desired. Although discs 41 are shown as being located axially inward of flanges 36, it is contemplated that discs 41 could alternatively be generally aligned with (e.g., lying in the same general plane as) flanges 36.

Power source 20 may be a hydraulic motor, for example a high-torque/low-speed motor. A high-torque/low-speed motor may include any motor capable of producing an output torque of up to about 275 kNm (kilonewton-meters) and an output speed of about 300 rpm (revolutions per minute) or less when supplied with a fluid (e.g., hydraulic oil) having a pressure of about 350 bar at a flowrate of about 1000 lpm (liters per minute). For the purposes of this disclosure, the term "about" may refer to an amount within engineering, manufacturing, and/or operational tolerances. In the disclosed embodiment, power source 20 is a radial-piston motor.

Power source 20 may include features that allow direct mounting of stationary portions to vertical plate 26 and direct connection of rotational portions to shaft 32. For the purposes of this disclosure, the term "direct" may be interpreted as "without intervening components." For example, power source 20 may be connected to vertical plate 26 and shaft 32, without a reducing gear box therebetween. Power source 20 may include any number of fasteners 42 that extend from a housing 44 of power source 20 and engage connection features 29 of vertical plates 26, and internal connection features (e.g., splines) 46 that engage external features 40 of shaft 32.

FSB 22 may be hydro-mechanical device configured to inhibit rotation of drum 18 when system 10 experiences a failure (e.g., an electrical power failure). In particular, FSB 22 may include features that allow direct mounting of stationary portions to vertical plate 26 and direct connection of rotational portions to shaft 32. These features may include any number of fasteners 48 that extend from a housing 50 of FSB 22 and engage connection features 29 of vertical plates 26, and internal connection features (e.g., splines) 52 that engage external features 40 of shaft 32. FSB 22 may also include spring-biased friction elements that are disengaged (e.g., via a supply of pressurized fluid—described in more detail below) during normal operation of system 10, such that the rotating components of FSB 22 (as well as shaft 32 and spool 30) are free to rotate relative to the stationary components (and vertical plates 26). Upon loss of electrical power, the pressurized fluid holding the friction elements in the disengaged state may be drained away from FSB 22, allowing the friction elements to be biased into engagement and thereby lock the rotation of shaft 32 (and spool 30) to vertical plates 26.

In the embodiment of FIG. 1, drum 18 may be rotationally supported between vertical plates 26 by way of power source 20 and FSB 22. In particular, each of power source 20 and FSB 22 may include at least one bearing (e.g., a roller or needle bearing) 54 disposed within the corresponding housing 44 or 50 that is configured to rotationally receive the associated end 38 of shaft 32. In this way, drum 18 may be able to rotate relative to support 16, without requiring dedicated drum bearings. That is, each of bearings 54 may be configured to support both the corresponding end 39 of shaft 32 and the rotating components of power source 20 or FSB 22.

Hydraulic circuit 14 may include a plurality of components that cooperate to selectively provide pressurized fluid to power source 20 and FSB 22, thereby causing drum 18 to haul in the associated tether, pay out the tether, or remain stationary. These components may include, among other things, a pump 56, a reservoir 58, a motor supply passage 60, an FSB supply passage 62, a motor drain passage 64, an FSB drain passage 66, a motor control valve 68, and an FSB control valve 70. Pump 56 may be configured to draw fluid from reservoir 58, pressurize the fluid, and direct the pressurized fluid to power source 20 and FSB 22 via the respective supply passages 60 and 62 and control valves 68 and 70.

Control valve 68 may be selectively moved (e.g., electrically, mechanically, and/or hydraulically) from a first or neutral position (i.e., a position at which drum 18 is not driven to rotate—shown in FIG. 1) to a second position (not shown) at which the pressurized fluid from supply passage 60 passes through power source 20 (and thereby drives the rotation of power source 20) in a haul-in direction or to a third position (not shown) at which the pressurized fluid passes from supply passage through power source 20 (and thereby drives the rotation of power source 20) in a pay-out direction. After passing through power source 20, the fluid (now reduced in pressure) may be allowed to return to reservoir 58 via drain passage 64. In some embodiments, a filter, cooler, and/or bypass arrangement 72 may be associated with drain passage 64 to condition the fluid prior to the fluid reaching reservoir 58. In addition, a pressure relief valve 74 may be provided to selectively connect supply passage 60 with drain passage 64 when a pressure of the fluid in supply passage 60 exceeds a threshold level.

Control valve 70 may be biased to a first position (shown in FIG. 1) at which fluid is drained from FSB 22 (e.g., via drain passage 66) and FSB 22 is engaged (i.e., drum 18 is inhibited from rotation). Control valve 70 may be selectively moved (e.g., electrically and/or electro-hydraulically) during normal operation (i.e., when electrical power is available) to a second position at which pressurized fluid is provided to FSB 22 (e.g., via supply passage 62) and FSB 22 is disengaged (i.e., drum 18 is free to rotate).

Figure 2:
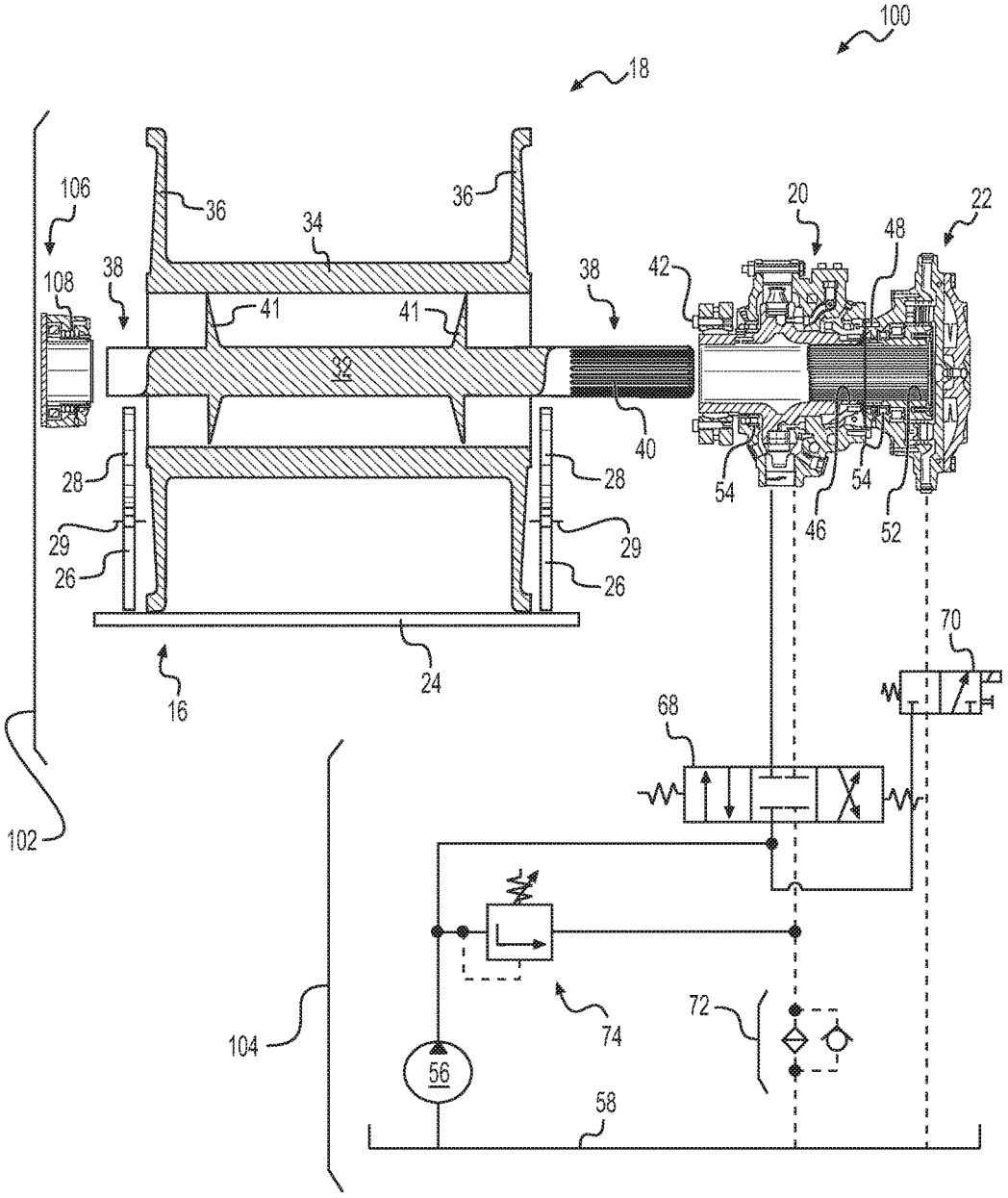
FIG. 2 is a diagrammatic illustration of another exemplary winch system.

FIG. 2 illustrates another exemplary winch system ("system") 100. System 100 may include a winch assembly ("assembly") 102, and a hydraulic circuit 104 that is substantially identical to hydraulic circuit 14 of FIG. 1 and configured to power assembly 102. Like winch assembly 12 of FIG. 1, winch assembly 102 of FIG. 2 may include support 16, drum 18, power source 20, and FSB 22. FSB 22 of winch assembly 102 may be mounted together with power source 20 at the same end of drum 18. For example, shaft 32 of drum 18 may include external connection features 40 at only one end 38 (i.e., at the right end shown in the perspective of FIG. 2), and external connection features 40 may have a greater axial length in the embodiment of FIG. 2. In addition, housing 44 of power source 20 may be open at an outer end, such that shaft 32 passes completely therethrough. FSB 22, instead of being mounted directly to support 16 via fasteners 48, may be mounted directly to power source 20 (e.g., to housing 44) via fasteners 48. In this arrangement, shaft 32 may extend through power source 20 and into FSB 22, such that external connection features 40 engage both internal connection features 46 and internal connection features 52. Bearings 54 of power source 20 may still rotationally support drum 18 (e.g., via shaft 32) at one end 38 (along with the rotating components of power source 20), but bearings 54 of FSB 22 may support only the rotating components of FSB 22.

An additional and dedicated bearing 106 may be used to support shaft 32 at the opposing end 38 of drum 18 (i.e., at the end 38 opposite power source 20). Bearing 106 may include a stationary portion that can be mounted directly to vertical plate 26 via fasteners 108, and rotational components that engage a non-splined end 38 of shaft 32.

Figure 3:
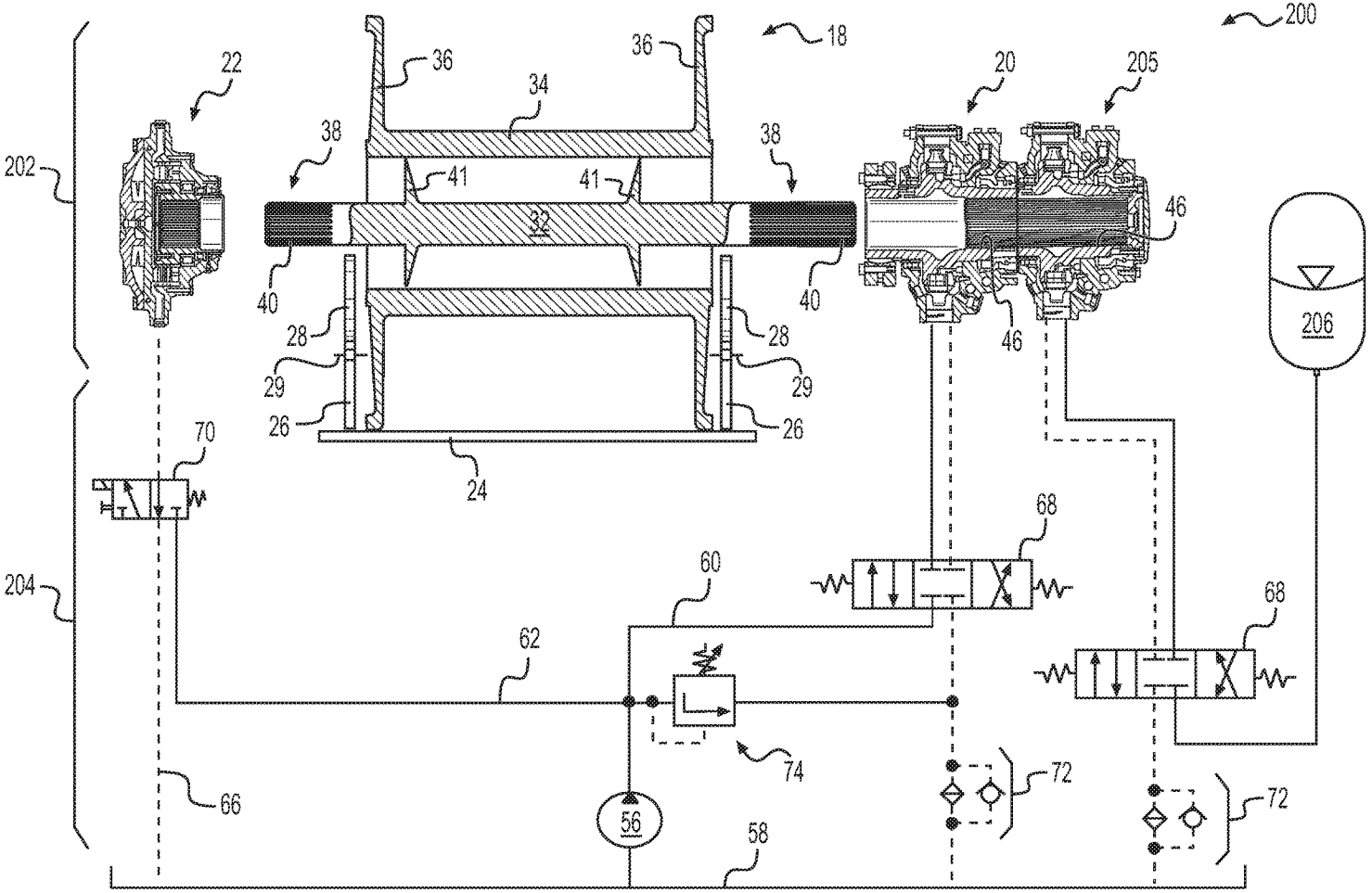
FIG. 3 is a diagrammatic illustration of another exemplary winch system.

FIG. 3 illustrates another exemplary winch system ("system") 200. System 200 may include a winch assembly ("assembly") 202, and a hydraulic circuit 204 that is configured to power assembly 202. Like winch assembly 12 of FIG. 1, winch assembly 202 of FIG. 3 may include support 16, drum 18, power source 20, and FSB 22 in nearly the exact same configuration. However, winch assembly 202 may additionally include a high-torque/low-speed pump 205. In the disclosed embodiment, pump 205 is substantially identical to power source 20, and simply plumbed and operated as a pump. It is contemplated, however, that a different pump could be used, if desired.

In the embodiment of FIG. 3, shaft 32 of drum 18 may include external connection features 40 at both ends 38 (similar to the embodiment of FIG. 1), however the external connection features 40 at the power-source end (i.e., the end 38 adjacent power source 20) may have a greater axial length (similar to the embodiment of FIG. 2). In addition, housing 44 of power source 20 may be open at an outer end, such that shaft 32 passes completely therethrough. Pump 205 may be mounted directly to power source 20 (e.g., to housing 44), such that shaft 32 extends through power source 20 and into pump 205. External connection features 40 at the power-source end may engage the internal connection features 46 of both power source 20 and pump 205. Bearings 54 of power source 20 may still support drum 18 (e.g., via shaft 32) at one end 38 (along with the rotating components of power source 20), but bearings 54 of pump 205 may support only the rotating components of pump 205.

Hydraulic circuit 204 of FIG. 3 may include all of the same components of hydraulic circuit 14 shown in FIGS. 1 and 2, as well as components associated with pump 205. These additional components may include an additional control valve 68 (e.g., a control valve that is identical to control valve 68 already described above), and an accumulator 206. Control valve 68 may be used to allow fluid pressurized by pump 205 to flow into and be stored within accumulator 206, and for the stored fluid to be selectively passed back through pump 205 to reservoir 58. The fluid may pass from pump 205 into accumulator 206 for storage at a time of excess power (e.g., during an overrunning condition, when the tension in the tether coiled around drum 18 urges drum 18 to rotate in the same direction that power source 20 is urging drum 18 to rotate). The fluid may pass from accumulator 206 through pump 205 at a time of low power (e.g., during a normal operating condition, when the tension in the tether is acting in a direction opposite a driving direction of power source 20) to supplement the power imparted by power source 20 to drum 18 and/or to reduce an amount of energy required from power source 20. With this configuration, re-use of the excess power stored in accumulator 206 at a time of low power may increase an efficiency of winch system 200.

Figure 4:
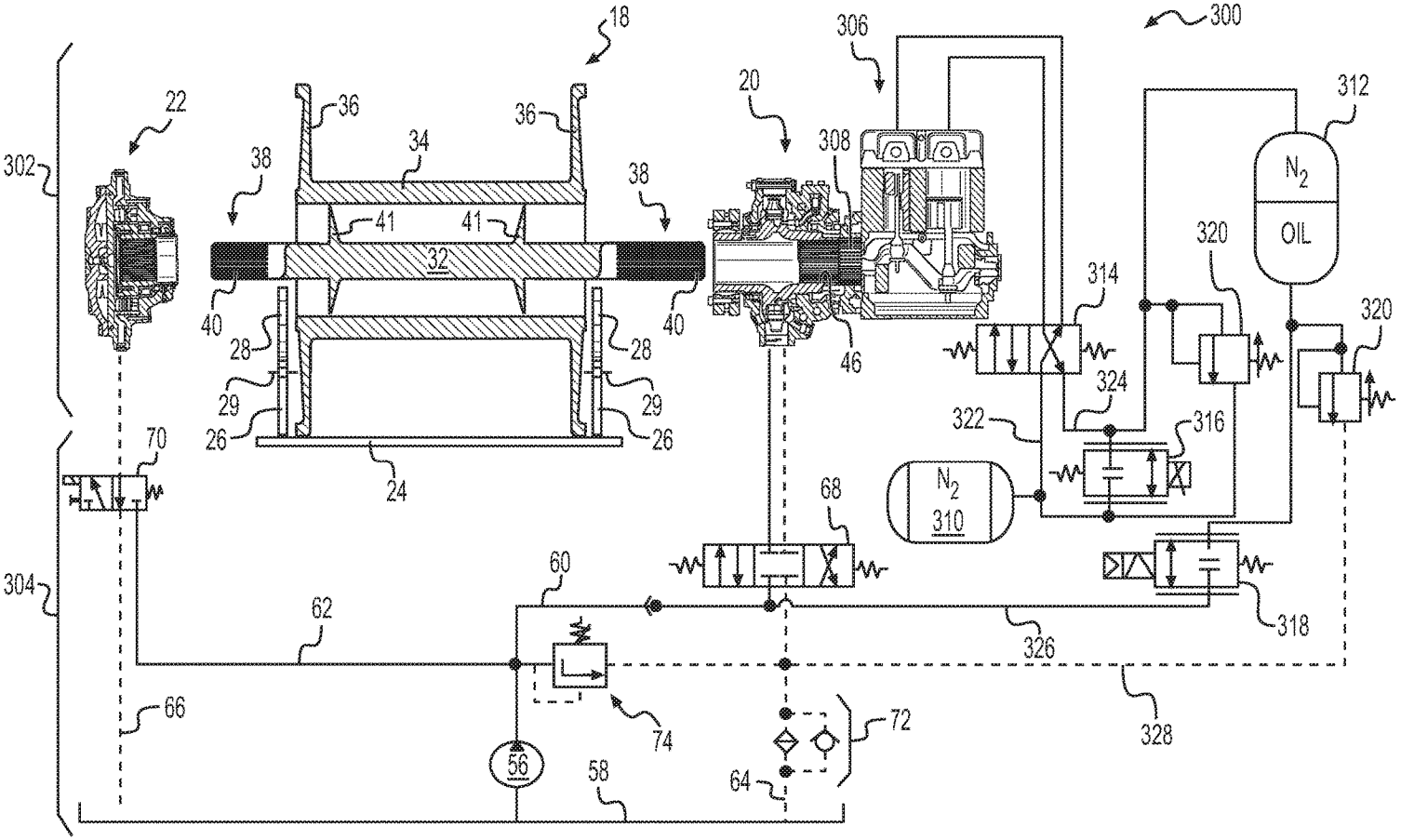
FIG. 4 is a diagrammatic illustration of another exemplary winch system.

FIG. 4 illustrates another exemplary winch system ("system") 300. System 300 may include a winch assembly ("assembly") 302, and a hydraulic circuit 304 that is configured to power assembly 302. Like winch assembly 12 of FIG. 1, winch assembly 302 of FIG. 4 may include support 16, drum 18, power source 20, and FSB 22 in a similar configuration. However, winch assembly 302 may additionally include a gas compressor 306. Compressor 306 may be any type of high-pressure compressor used, for example, to compress an inert gas (e.g. nitrogen, argon, helium, etc.).

In the embodiment of FIG. 4, shaft 32 of drum 18 may include external connection features 40 at both ends 38; however, the external connection features 40 at the power-source end may have a greater axial length. In addition, housing 44 of power source 20 may be open at an outer end, such that shaft 32 passes completely therethrough. Gas compressor 306 may be mounted directly to power source 20 (e.g., to housing 44), such that shaft 32 extends through power source 20 and into gas compressor 306. In this embodiment, external connection features 40 at the power-source end may engage the internal connection features 46 of both power source 20 and gas compressor 306. Bearings 54 of power source 20 may still support drum 18 (e.g., via shaft 32) at one end (along with the rotating components of power source 20), but gas compressor 306 may include bearings 308 that support only the rotating components of gas compressor 306.

Hydraulic circuit 304 of FIG. 4 may include all of the same components of hydraulic circuit 14 shown in FIGS. 1 and 2, as well as components associated with gas compressor 306. These additional components may include a gas supply 310, at least one accumulator 312, and a combination of control and pressure relief valves (e.g., a switching valve 314, a recirculation valve 316, an accumulator control valve 318, and any number of pressure relief valves 320). Gas compressor 306 may be connected to gas supply 310 by way of an inlet passage 322, and to accumulator 312 by way of an outlet passage 324. Accumulator 312 may be connected to passage 60 (already described above) by way of a discharge passage 326, and to passage 64 (already described above) by way of a drain passage 328.

Switching valve 314 may be used to allow supply gas to flow from supply 310 to gas compressor 306 and for gas compressed by compressor 306 to flow into and be stored within accumulator 312, regardless of the rotational direction of gas compressor 306. Recirculation valve 316 may selectively create a closed loop at compressor 306 at a time when accumulator 312 is already full of compressed gas and/or at a time when parasitic losses associated with gas compressor 306 should remain low (e.g., during a lower-power condition). Accumulator control valve 318 may be used to selectively direct high-pressure fluid (e.g., hydraulic oil) from power source 20 into accumulator 312, or to selectively direct high-pressure fluid from accumulator 312 back through power source 20 to reservoir 58. The fluid may pass from power source 20 into accumulator 312 during the overrunning condition, and the fluid may pass from accumulator 312 back through power source 20 at a time of low power to supplement pump 56 and/or to reduce an amount of energy required from pump 56. With this configuration, re-use of the excess power at a time of low power may increase an efficiency of winch system 300. By using gas compressor 306, in connection with accumulator 312, the pressure of the fluid stored within accumulator 312 may be elevated above what can be normally produced by power source 20 during the overrunning condition. This elevated pressure may further improve the efficiency of winch system 300.

INDUSTRIAL APPLICABILITY

The disclosed winch systems and assemblies may be used in any application where light-weight, compact, and low-cost arrangements are important. The disclosed winch assemblies may be light-weight, compact and low-cost because of the simplicity of their designs, the limited number of components, and the direct connections between the components. These design and connection configurations may be facilitated through the use of high-torque/low-speed motors, which may not require reducing planetary gear arrangements.

The disclosed winch systems and assemblies may also provide lower operating costs. For example, the ability to mount energy-recuperating components (e.g., pump 205 and/or gas compressor 306) directly to the disclosed high-torque/low-speed motors and to drive these components with shaft 32 during overrunning conditions, may allow for improved efficiency.

It will be apparent to those skilled in the art that various modifications and variations can be made to the disclosed winch systems and assemblies. Other embodiments will be apparent to those skilled in the art from consideration of the specification and practice of the disclosed winch systems and assemblies. It is intended that the specification and examples be considered as exemplary only, with a true scope being indicated by the following claims and their equivalents.

What is claimed is:

1. A winch assembly, comprising:

a support having parallel plates spaced apart from each other;

a drum having a hollow spool between the parallel plates, and a shaft having first and second ends, the shaft passing axially through and being connected to the hollow spool;

a motor directly connected to one of the first and second ends of the shaft; and a fail-safe-brake directly connected to one of the first and second ends of the shaft.

2. The winch assembly of claim 1, wherein the fail-safe-brake is connected to the first end of the shaft, and the motor is connected to the second end of the shaft opposite the fail-safe-brake.

3. The winch assembly of claim 1, wherein the shaft extends through the motor to engage the fail-safe-brake.

4. The winch assembly of claim 1, wherein the drum is rotationally held in the support by bearings of only the motor and the fail-safe-brake.

5. The winch assembly of claim 1, further including a dedicated drum bearing, wherein the drum is rotationally held in the support by a bearing of the motor and the dedicated drum bearing.

6. The winch assembly of claim 1, further including a pump connected to the motor, wherein the shaft extends through the motor to engage the pump.

7. The winch assembly of claim 6, wherein the pump is substantially identical to the motor.

8. The winch assembly of claim 1, further including a gas compressor connected to the motor, wherein the shaft extends through the motor to engage the gas compressor.

9. The winch assembly of claim 1, wherein the motor is a radial-piston motor.

10. The winch assembly of claim 1, wherein the motor produces an output torque of about 275 kNm and an output speed of about 300 rpm when supplied with fluid having a pressure of about 350 bar at a rate of about 1000 lpm.

11. A winch assembly, comprising:

a support having parallel plates spaced apart from each other;

a drum having a hollow spool between the parallel plates, and a shaft passing axially through and being connected to the hollow spool;

a radial-piston motor directly connected to a first end of the shaft; and an energy recuperation mechanism connected to the radial-piston motor, wherein the first end of the shaft extends through the radial-piston motor to engage the energy recuperation mechanism.

12. The winch assembly of claim 11, further including a fail-safe-brake directly connected to a second end of the shaft.

13. The winch assembly of claim 12, wherein the drum is rotationally held in the support by bearings of only the radial-piston motor and the fail-safe-brake.

14. The winch assembly of claim 11, wherein the energy recuperation mechanism is one of a pump and a gas compressor.

15. The winch assembly of claim 14, wherein the pump is substantially identical to the radial-piston motor.

16. The winch assembly of claim 11, wherein the radial-piston motor produces an output torque of about 275 kNm and an output speed of about 300 rpm when supplied with fluid having a pressure of about 350 bar at a rate of about 1000 lpm.

17. A winch system, comprising:

a support having parallel plates spaced apart from each other;

a drum having a hollow spool between the parallel plates, and a shaft passing axially through and being connected to the hollow spool;

a motor directly connected to a first end of the shaft;

an energy recuperation mechanism connected to the motor, wherein the shaft extends through the motor to engage the energy recuperation mechanism;

a pump configured to supply the motor with pressurized fluid;

an accumulator configured to receive pressurized fluid from one of the motor and the energy recuperation mechanism; and at least one control valve fluidly connected to the motor, the energy recuperation mechanism and the pump.

18. The winch system of claim 17, wherein:

the energy recuperation mechanism is a pump that is substantially identical to the motor;

the accumulator is configured to receive pressurized fluid from the energy recuperation mechanism when the motor is operating in an overrunning condition; and the accumulator is further configured to discharge pressurized fluid to the energy recuperation mechanism to reduce a load on the motor.

19. The winch system of claim 17, wherein:

the energy recuperation mechanism is a gas compressor;

the accumulator is configured to receive pressurized gas from the gas compressor;

the accumulator is configured to receive pressurized oil from the motor when the motor is operating in an overrunning condition; and the accumulator is further configured to discharge pressurized oil to the motor to reduce a load on the motor.

20. The winch system of claim 17, further including a fail-safe-brake directly connected to a second end of the shaft and configured to receive pressurized fluid from the pump during a normal operation.

* * * * *